US009868288B2

(12) United States Patent
Nagashima et al.

(10) Patent No.: US 9,868,288 B2
(45) Date of Patent: Jan. 16, 2018

(54) CLEANING LIQUID FOR INKJET RECORDING APPARATUS, METHOD FOR CLEANING INKJET RECORDING APPARATUS, RECORDING METHOD, AND CLEANING AND FILLING LIQUID

(71) Applicants: Hidefumi Nagashima, Kanagawa (JP); Naohiro Toda, Kanagawa (JP); Juichi Furukawa, Kanagawa (JP); Masahiro Kido, Kanagawa (JP); Takashi Tamai, Kanagawa (JP); Ichiroh Fujii, Kanagawa (JP); Hisashi Habashi, Kanagawa (JP)

(72) Inventors: Hidefumi Nagashima, Kanagawa (JP); Naohiro Toda, Kanagawa (JP); Juichi Furukawa, Kanagawa (JP); Masahiro Kido, Kanagawa (JP); Takashi Tamai, Kanagawa (JP); Ichiroh Fujii, Kanagawa (JP); Hisashi Habashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/201,741

(22) Filed: Jul. 5, 2016

(65) Prior Publication Data

US 2017/0015102 A1 Jan. 19, 2017

(30) Foreign Application Priority Data

Jul. 15, 2015 (JP) ..... 2015-141359
Apr. 28, 2016 (JP) ..... 2016-090168

(51) Int. Cl.

| | |
|---|---|
| ***B41J 2/21*** | (2006.01) |
| ***B41J 2/165*** | (2006.01) |
| ***C11D 3/43*** | (2006.01) |
| ***C11D 3/20*** | (2006.01) |
| ***C11D 3/30*** | (2006.01) |
| ***C11D 7/50*** | (2006.01) |
| ***C11D 11/00*** | (2006.01) |

(52) U.S. Cl.

CPC ..... *B41J 2/16552* (2013.01); *B41J 2/2107* (2013.01); *C11D 3/2044* (2013.01); *C11D 3/2065* (2013.01); *C11D 3/2068* (2013.01); *C11D 3/30* (2013.01); *C11D 3/43* (2013.01); *C11D 7/5022* (2013.01); *C11D 11/0041* (2013.01)

(58) Field of Classification Search

CPC ... B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; B41J 2/0057; B41J 3/60; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/95–105, 9–22

See application file for complete search history.

(56) References Cited

U.S. PATENT DOCUMENTS

| | | | | |
|---|---|---|---|---|
| 2009/0029898 | A1* | 1/2009 | Voelkel | C11D 1/62 510/353 |
| 2009/0237445 | A1* | 9/2009 | Park | B41J 2/16552 347/28 |
| 2013/0194345 | A1 | 8/2013 | Tamai et al. | |
| 2014/0085376 | A1* | 3/2014 | Kato | B41J 2/16552 347/33 |

FOREIGN PATENT DOCUMENTS

| | | |
|---|---|---|
| JP | 54-059936 | 5/1979 |
| JP | 56-064877 | 6/1981 |
| JP | 6-071882 | 3/1994 |
| JP | 7-109493 | 4/1995 |
| JP | 8-188797 | 7/1996 |
| JP | 2000-053897 | 2/2000 |
| JP | 2001-139849 | 5/2001 |
| JP | 2005-146224 | 6/2005 |
| JP | 2007-091846 | 4/2007 |
| JP | 2011-140556 | 7/2011 |
| JP | 2013-158918 | 8/2013 |
| JP | 2014-177589 | 9/2014 |

OTHER PUBLICATIONS

Science Lab.com; Material Safety Data Sheet 2-Pyrrolidone; Oct. 9, 2005 pp. 1-5.*

* cited by examiner

*Primary Examiner* — Manish S Shah
(74) *Attorney, Agent, or Firm* — Cooper & Dunham LLP

(57) ABSTRACT

A cleaning liquid for an inkjet recording apparatus is provided. The cleaning liquid includes an organic solvent having a boiling point of less than 250° C. and no organic solvent having a boiling point of 250° C. or more. The organic solvent having a boiling point of less than 250° C. includes two or more methoxy-group-containing organic solvents and at least one of 1,2-propanediol, 1,3-propanediol, 1,2-butanediol, and 2,3-butanediol.

7 Claims, No Drawings

CLEANING LIQUID FOR INKJET RECORDING APPARATUS, METHOD FOR CLEANING INKJET RECORDING APPARATUS, RECORDING METHOD, AND CLEANING AND FILLING LIQUID

CROSS-REFERENCE TO RELATED APPLICATIONS

This patent application is based on and claims priority pursuant to 35 U.S.C. §119(a) to Japanese Patent Application Nos. 2015-141359 and 2016-090168, filed on Jul. 15, 2015 and Apr. 28, 2016, in the Japan Patent Office, the entire disclosure of each of which is hereby incorporated by reference herein.

BACKGROUND

Technical Field

The present disclosure relates to a cleaning liquid for an inkjet recording apparatus, a method for cleaning an inkjet recording apparatus, a recording method, and a cleaning and filling liquid.

Description of the Related Art

Inkjet recording apparatuses are generally subjected to a printing test (discharge test) using a test ink before shipment. After the printing test, the residual test ink is washed away by a cleaning liquid. The cleaning liquid is generally required to have appropriate wettability to ink supply passages and cleaning power. To meet this requirement, conventional cleaning liquids generally contain a surfactant to have wettability and cleaning power.

Conventional cleaning liquids are easy to foam due to the presence of surfactant, and disadvantageously, the generated foam causes a trouble in cleaning operations. When such a conventional cleaning liquid, even in a slight amount, remains in inkjet recording apparatuses after shipment, an initial failure will be caused in ink filling operations. Depending on the type of surfactants used, conventional cleaning liquids may deteriorate ink supply passage members or corrode metallic members. Moreover, conventional cleaning liquids may have poor compatibility with the test ink which will remain in the apparatus in a slight amount to cause defective discharge. Conventional cleaning liquids may further deteriorate ink-repelling property of ink-discharging heads.

Cleaning liquids generally include an organic solvent for the purpose of being prevented from drying when in ink supply passages and being easily mixable with the refilled ink when remaining in the ink supply passages. In the latter case, depending on the type of organic solvents included in the mixture of the ink and the residual cleaning liquid, images printed on a non-porous substrate immediately after refilling of ink may be fixed on the substrate with poor fixing strength.

On the other hand, non-porous substrates (e.g., plastic films) are now used for various industrial applications, such as displays, posters, and bulletin boards, and inks and cleaning liquids have been developed therefor.

SUMMARY

In accordance with some embodiments of the present invention, a cleaning liquid for an inkjet recording apparatus is provided. The cleaning liquid includes an organic solvent having a boiling point of less than 250° C. and no organic solvent having a boiling point of 250° C. or more. The organic solvent having a boiling point of less than 250° C. includes two or more methoxy-group-containing organic solvents and at least one of 1,2-propanediol, 1,3-propanediol, 1,2-butanediol, and 2,3-butanediol.

In accordance with some embodiments of the present invention, a method for cleaning an inkjet recording apparatus is provided. The method includes the steps of filling the above cleaning liquid in an ink supply passage of the inkjet recording apparatus which is filled with an ink and flowing the cleaning liquid in the ink supply passage. In the method, the following formula is satisfied:

$$(A2/A1)\times 100\leq 2 \quad (1)$$

where A1 represents an absorbance of the ink and A2 represents an absorbance of a liquid present in the ink supply passage after the flowing.

In accordance with some embodiments of the present invention, a method for cleaning an inkjet recording apparatus is provided. The method includes the steps of filling the above cleaning liquid in an ink supply passage of the inkjet recording apparatus which is filled with an ink, discharging the cleaning liquid from the ink supply passage, and repeating the filling and the discharging until the following formula is satisfied:

$$(A2/A1)\times 100\leq 2 \quad (1)$$

where A1 represents an absorbance of the ink and A2 represents an absorbance of a liquid present in the ink supply passage after the discharging.

In accordance with some embodiments of the present invention, a recording method is provided. The recording method includes the steps of filling an ink supply passage of an inkjet recording apparatus with the above cleaning liquid, refilling the ink supply passage with an ink; and discharging the ink from the ink supply passage onto a non-porous substrate to record an image thereon.

In accordance with some embodiments of the present invention, a cleaning and filling liquid is provided. The cleaning and filling liquid includes the above cleaning liquid.

DETAILED DESCRIPTION

Embodiments of the present invention are described in detail below. In describing embodiments illustrated in the drawings, specific terminology is employed for the sake of clarity. However, the disclosure of this patent specification is not intended to be limited to the specific technology so selected, and it is to be understood that each specific element includes all technical equivalents that operate in a similar manner and achieve a similar result.

In accordance with some embodiments of the present invention, a cleaning liquid for inkjet recording apparatuses which: generates less foam; has a good combination of wettability, cleaning ability, refilling property, and compatibility with pigment inks; gives initial images good drying property; and provides a high degree of safety is provided.

Cleaning liquids for inkjet recording apparatuses generally:

(1) have high cleaning ability for detaching and washing away foreign substances in ink supply passages; and (2) do not deteriorate the ink supply passage members since the cleaning liquids detach ink components from the ink supply passages by being mixed and replaced with the ink in the ink supply passage.

The cleaning liquid according to an embodiment of the present invention includes: two or more methoxy-group-containing organic solvents each having a boiling point of less than 250° C.; and at least one of 1,2-propanediol, 1,3-propanediol, 1,2-butanediol, and 2,3-butanediol, each of which having a boiling point of less than 250° C. This cleaning liquid is compatible with foam that may be generated due to the presence of surfactants and ink colorant components that may remain in the apparatus in slight amounts. At the same time, this cleaning liquid secures the same level of wettability and cleaning ability as conventional surfactant-containing cleaning liquids. Thus, the cleaning liquid according to an embodiment of the present invention is capable of sufficiently exerting its cleaning function. Additionally, since no high-boiling-point solvent (e.g., glycerin) is included in the cleaning liquid according to an embodiment of the present invention, the initial image formed immediately after refilling of ink exhibits excellent drying property, especially when the image is printed on a non-porous substrate.

The cleaning liquid according to an embodiment of the present invention can also be used as a filling liquid for filling ink supply passages of inkjet recording apparatuses to preserve inkjet heads and ink supply passages.

The cleaning liquid according to an embodiment of the present invention can be used as not only a cleaning liquid but also a filling liquid or a cleaning and filling liquid, and may be hereinafter referred to as "cleaning and filling liquid".

Constituents of the cleaning liquid according to an embodiment of the present invention are described in detail below.

Organic Solvent

The cleaning and filling liquid includes an organic solvent for the purpose of being prevented from drying when in ink supply passages and being easily mixable with the refilled ink when remaining in the ink supply passages. Therefore, preferably, the organic solvent has high compatibility with a test ink that is used in a discharge test conducted before shipment as well as a regular ink used for printing. Thus, organic solvents which have been generally used for inkjet inks are preferably used for the cleaning and filling liquid according to an embodiment of the present invention. Examples of such organic solvents include water-soluble organic solvents.

According to an embodiment of the present invention, the organic solvent included in the cleaning and filling liquid has a boiling point of less than 250° C. More specifically, the organic solvent having a boiling point of less than 250° C. includes: (A) two or more methoxy-group-containing organic solvents; and (B) at least one of 1,2-propanediol, 1,3-propanediol, 1,2-butanediol, and 2,3-butanediol.

The organic solvent may further include (C) another organic solvent having a boiling point of less than 250° C.

Specific examples of the methoxy-group-containing organic solvents (A) include, but are not limited to, 3-methoxy-3-methyl-1-butanol, 3-methoxy-N,N-dimethylpropionamide, propylene glycol monomethyl ether, ethylene glycol monomethyl ether, dipropylene glycol monomethyl ether, diethylene glycol monomethyl ether, triethylene glycol monomethyl ether, and tetraethylene glycol monomethyl ether.

In particular, when 3-methoxy-3-methyl-1-butanol and 3-methoxy-N,N-dimethylpropionamide are used in combination, the cleaning and filling liquid provides improved compatibility with inks, thus providing improved cleaning ability. In addition, in this case, cleaning residues are prevented from aggregating. At the time of ink filling, the cleaning and filling liquid can be rapidly mixed with the filled ink without aggregating. Preferably, the methoxy-group-containing organic solvents account for 5.0% to 20.0% by mass of the cleaning and filling liquid, to improve cleaning ability of the cleaning and filling liquid.

3-Methoxy-N,N-dimethylpropionamide is represented by the following formula (1).

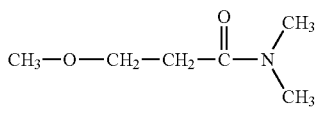

(1)

Since the cleaning and filling liquid includes (B) at least one of 1,2-propanediol, 1,3-propanediol, 1,2-butanediol, and 2,3-butanediol, the initial image formed immediately after refilling of ink exhibits excellent drying property, especially when the image is printed on a non-porous substrate. In addition, the image tends to exhibit high gloss.

Specific examples of the organic solvent (C) other than the organic solvents (A) and (B) include, but are not limited to: polyols, such as ethylene glycol, diethylene glycol, 1,4-butanediol, 3-methyl-1,3-butanediol, triethylene glycol, polyethylene glycol, polypropylene glycol, 1,5-pentanediol, 1,6-hexanediol, glycerin, 1,2,6-hexanetriol, 2-ethyl-1,3-hexanediol, ethyl-1,2,4-butanetriol, 1,2,3-butanetriol, and 3-methyl-1,3,5-pentanetriol; alkyl ethers of polyols, such as ethylene glycol monobutyl ether, diethylene glycol monoethyl ether, and diethylene glycol monobutyl ether; aryl ethers of polyols, such as ethylene glycol monophenyl ether and ethylene glycol monobenzyl ether; nitrogen-containing heterocyclic compounds, such as 2-pyrrolidone, N-methyl-2-pyrrolidone, N-hydroxyethyl-2-pyrrolidone, 1,3-dimethyl imidazolidinone, E-caprolactam, and y-butyrolactone; amides, such as formamide, N-methylformamide, and N,N-dimethylformamide; amines, such as monoethanolamine, diethanolamine, and triethylamine; sulfur-containing compounds, such as dimethyl sulfoxide, sulfolane, and thiodiethanol; propylene carbonate; and ethylene carbonate. Each of these solvents can be used alone or in combination with others.

When the organic solvent having a boiling point of less than 250° C. accounts for 25% by mass or more of the cleaning and filling liquid, the amount of energy required for drying the initial image printed immediately after refilling of ink on a non-porous substrate can be reduced. Thus, during ink supply, images with good fixability are constantly obtained.

The cleaning and filling liquid according to an embodiment of the present invention does not include an organic solvent having a boiling point of 250° C. or more as a constituent, but may include it as a reaction by-product or a drying preventing agent in a very small amount approximately equal to that of impurities. In particular, the cleaning and filling liquid can include an organic solvent having a boiling point of 250° C. or more only when the content rate thereof is 1.5% by mass or less.

The cleaning and filling liquid according to an embodiment of the present invention may include other additives, such as an antiseptic antifungal agent, a chelate agent, an antirust, a pH adjuster, and a humectant, if needed. Preferably, these agents have the same composition as those used for inks.

Specific examples of the antiseptic antifungal agent include, but are not limited to, sodium dehydroacetate, sodium sorbate, 2-pyridinethiol-1-oxide sodium, sodium benzoate, and pentachlorophenol sodium.

Specific examples of the chelate agent include, but are not limited to, ethylenediaminetetraacetic acid tetrasodium salt, nitrilotriacetic acid trisodium salt, hydroxyethylethylenediaminetriacetic acid trisodium salt, diethylenetriaminepentaacetic acid pentasodium salt, and uramildiacetic acid disodium salt.

Specific examples of the antirust include, but are not limited to, acid sulphite, sodium thiosulfate, ammonium thiodiglycolate, diisopropylammonium nitrite, pentaerythritol tetranitrate, and dichlorohexylammonium nitrite, and benzotriazole.

Any substance can be used as the pH adjuster so long as the cleaning and filling liquid is not adversely affected thereby and ink supply passages of inkjet recording apparatuses are not damaged thereby. For example, when adjusting pH to be basic, amines (e.g., diethanolamine, triethanolamine), alkali metal hydroxides (e.g., sodium hydroxide), quaternary compound hydroxides (e.g., quaternary ammonium hydroxide), and alkali metal carbonates (e.g., sodium carbonate) may be used as the pH adjuster. When adjusting pH to be acid, inorganic acids (e.g., hydrochloric acid, sulfuric acid) and organic acids (e.g., acetic acid, oxalic acid) may be used as the pH adjuster.

The humectant supplements permeability of the organic solvent. Preferably, the humectant is a polyol having a water solubility of from 0.2% to 5.0% by mass at 20° C. Specific examples of such a polyol include, but are not limited to, aliphatic diols such as 2-ethyl-1,3-hexanediol and 2,2,4-trimethyl-1,3-pentanediol.

In addition, alkyl or aryl ethers of polyols (e.g., diethylene glycol monophenyl ether, ethylene glycol monophenyl ether, diethylene glycol monobutyl ether) and lower alcohols (e.g., ethanol) can be used in combination with the above-described polyol.

The humectant may include a solid humectant, such as a sugar. Examples of the sugar include monosaccharides, disaccharides, oligosaccharides (including trisaccharides and tetrasaccharides), and polysaccharides. Specific examples of the sugar include, but are not limited to, glucose, mannose, fructose, ribose, xylose, arabinose, galactose, maltose, cellobiose, lactose, sucrose, trehalose, and maltotriose. Here, the polysaccharides refer to sugar in a broad sense, including substances existing widely in nature, such as α-cyclodextrin and cellulose. Specific examples of the sugar further include sugar derivatives such as reducing sugars (e.g., a sugar alcohol represented by the general formula $HOCH_2(CHOH)_nCH_2OH$, wherein n represents an integer of from 2 to 5), oxidized sugars (e.g., aldonic acid, uronic acid), amino acid, and thio acid. Among these sugar derivatives, sugar alcohols, such as maltitol and sorbitol, are preferable.

A surfactant can be used in combination without compromising the effect of the humectant.

Any type of inks, such as those containing resin particles and those having a high solid content concentration, can be effectively washed away with the cleaning and filling liquid according to an embodiment of the present invention. The inks are not limited in composition. The inks may include a colorant, a fine resin particle, a surfactant, an organic solvent, a penetrant, a defoamer, and any other additives. The surfactant, the organic solvent, the penetrant, and other additives included in the above-described cleaning liquid can be included in the ink.

Colorant

The ink may include either a pigment or a dye as a colorant. Pigments are more preferable than dyes in terms of color fading.

Usable pigments include both organic pigments and inorganic pigments. The ink may include a dye in combination with a pigment for the purpose of adjusting color tone without compromising fade resistance.

Specific examples of the inorganic pigments include, but are not limited to, iron oxide, calcium carbonate, barium sulfate, aluminum hydroxide, barium yellow, cadmium red, chrome yellow, titan yellow, and carbon black. Among these inorganic pigments, carbon black is preferable.

Specific examples of the organic pigments include, but are not limited to, azo pigments, polycyclic pigments, dye chelates, nitro pigments, nitroso pigments, and aniline black.

Among these organic pigments, azo pigments and polycyclic pigments are preferable.

Examples of dyes usable alone or in combination with the pigment include acid dyes, food dyes, direct dyes, basic dyes, reactive dyes, and dispersed dyes. Among these dyes, acid dyes and food dyes are preferable in terms of water solubility and color developing property.

Preferably, usable pigments are surface-modified to express self-dispersibility in water. Preferably, a surface-modified pigment is prepared by bonding at least one type of hydrophilic group to a pigment directly or via an atomic group. Specifically, such a surface-modified pigment is prepared by chemically bonding a specific functional group (e.g., sulfone group, carboxyl group) to a pigment or subjecting a pigment to a wet oxidization process using hypohalous acid and/or a salt thereof.

An ink including such a self-dispersible pigment has good redispersibility even after being dried. Even in a case in which a printing operation has been suspended for a long time and moisture of the ink existing near nozzles of an inkjet head has been evaporated, it is possible to reliably resume the printing operation with a simple cleaning operation without causing ink clogging.

In particular, when such a self-dispersible pigment is used in combination with a surfactant and a penetrant, highly-reliable high-quality images can be obtained owing to their great synergistic effect.

In addition to the self-dispersible pigment, an emulsion of fine polymer particles containing a pigment (hereinafter "polymer emulsion") can also be used.

In the polymer emulsion, the pigment may be either incorporated in the fine polymer particles or adsorbed to the surfaces of the fine polymer particles. Not all the pigment needs to be incorporated in and/or adsorbed to the fine polymer particles, and a part of the pigment can be solely dispersed in the emulsion without compromising its effect.

Examples of the polymer used for the polymer emulsion include vinyl polymer, polyester polymer, and polyurethane polymer. Specifically, vinyl polymers and polyester polymers, such as polymers described in Japanese Unexamined Patent Application Publication Nos. 2000-53897 and 2001-139849, are preferable.

Examples of usable colorants further include pigment dispersions in which a pigment is dispersed by a pigment dispersant and/or a polymer dispersion stabilizer.

Specific examples of the polymer dispersion stabilizer include, but are not limited to, copolymer of α-olefin with maleic anhydride, styrene-acrylic copolymer, styrene-methacrylic copolymer, water-soluble polyurethane resin, and water-soluble polyester resin.

Specific preferred examples of the pigment dispersant include nonionic surfactants having a hydrophilic-lipophilic balance (HLB) of from 10 to 20. Specific examples of the nonionic surfactants having an HLB of from 10 to 20 include, but are not limited to, polyoxyethylene alkyl ether, polyoxyalkylene alkyl ether, polyoxyethylene polycyclic phenyl ether, sorbitan fatty acid ester, polyoxyethylene sorbitan fatty acid ester, polyoxyethylene alkyl phenyl ether, polyoxyethylene alkylamine, polyoxyethylene alkylamide, and acetylene glycol. Among these surfactants, polyoxyethylene lauryl ether, polyoxyethylene-β-naphthyl ether, polyoxyethylene sorbitan monooleate, and polyoxyethylene styrene phenyl ether are preferable.

The colorant is not limited in its color. Any colorant used for black-and-white printing or color printing can be used.

One type of colorant can be used alone, or two or more types of colorants can be used in combination.

The content rate of the colorant in the ink is preferably in the range of from 1% to 20% by mass, more preferably from 5% to 15% by mass.

Fine Resin Particle

The ink may include a fine resin particle. For example, fine particles of acrylic resin, polyolefin resin, vinyl acetate resin, vinyl chloride resin, fluorine-containing resin, polyether resin, and polyester resin can be used.

The ink may also include a fine particle of polycarbonate urethane resin. Preferably, the polycarbonate urethane resin accounts for 50% by mass or more of the total resin in the ink. More preferably, the polycarbonate urethane resin accounts for 70% by mass or more of the total resin in the ink.

Inkjet Recording Apparatus

The cleaning and filling liquid according to an embodiment of the present invention may be preferably used for inkjet recording apparatuses which include a pressure generator, for pressurizing ink in an ink supply passage, of any of the following types: a piezo type in which a piezoelectric element deforms a vibration plate that is forming a wall surface of the ink supply passage to vary the inner volume of the ink supply passage to discharge droplets of the ink (as described in Japanese Examined Patent Application Publication No. 02-51734, corresponding to Japanese Unexamined Patent Application Publication No. 56-064877); a thermal type in which a heat element heats an ink in the ink supply passage to generate bubbles (as described in Japanese Examined Patent Application Publication No. 61-59911, corresponding to Japanese Unexamined Patent Application Publication No. 54-059936); and an electrostatic type in which a vibration plate that is forming a wall surface of the ink supply passage and an electrode are facing each other and an electrostatic force generated between the vibration plate and the electrode deforms the vibration plate to vary the inner volume of the ink supply passage to discharge droplets of the ink (as described in Japanese Unexamined Patent Application Publication No. 06-71882).

The cleaning and filling liquid according to an embodiment of the present invention can be applied to any field.

In particular, the cleaning and filling liquid according to an embodiment of the present invention is preferably applied to inkjet image forming apparatuses (e.g., printers). For example, inkjet image forming apparatuses can be shipped with ink supply passages (except for heads) thereof filled with the cleaning and filling liquid.

In the method for cleaning an inkjet recording apparatus according to an embodiment of the present invention, the cleaning and filling liquid is repeatedly filled in and discharged from an ink supply passage of the inkjet recording apparatus. More specifically, for example, the cleaning and filling liquid is contained in a cartridge, and repeatedly filled in and discharged from the ink supply passage using filling and suction mechanisms of the inkjet recording apparatus body. As another example, the cleaning and filling liquid is contained in an ink container of the inkjet recording apparatus body, and repeatedly filled in and discharged from the ink supply passage by externally pressurizing the ink container. As another example, the cleaning and filling liquid is filled in and discharged (sucked) from the ink supply passage using an external pump from the head side. Using a cartridge containing the cleaning and filling liquid is preferable because the cartridge is easy to clean. Preferably, the process of filling/discharging the cleaning and filling liquid in/from the ink supply passage is repeated until the colorant particle density in the discharged liquid becomes 2% by mass or less, in order to sufficiently clean the ink supply passage of the inkjet recording apparatus.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

Examples 1 to 8 and Comparative Examples 1 to 9

According to formulations described in Table 1, water, methoxy-group-containing organic solvents, other organic solvents, and surfactants were mixed and stirred at room temperature. The mixture was then filtered with a membrane filter having an average pore of 0.8 μm. Thus, cleaning and filling liquids of Examples 1 to 8 and Comparative Examples 1 to 9 were prepared.

Evaluation inks used for evaluating the above-prepared cleaning and filling liquids were prepared as follows.

Preparation of Evaluation Inks

Preparation of Polycarbonate Urethane Resin Emulsion A

A reaction vessel equipped with a stirrer, a reflux condenser, and a thermometer was charged with 1,500 g of polycarbonate diol (i.e., a reaction product of 1,6-hexanediol and dimethyl carbonate), 220 g of 2,2-dimethylol propionic acid (DMPA), and 1,347 g of propylene glycol dimethyl ether (having a boiling point of 171° C.) under nitrogen airflow. The vessel was heated to 60° C. to dissolve DMPA.

Further, 1,445 g of 4,4'-dicyclohexylmethane diisocyanate and 2.6 g of dibutyltin dilaurate (serving as a catalyst) were added to the vessel. The vessel was heated to 90° C. and the vessel contents were subjected to an urethane-forming reaction for 5 hours. Thus, an isocyanate-terminal urethane prepolymer was prepared.

The reaction mixture was cooled to 80° C. and further mixed with 149 g of triethylamine. The resulting mixture in an amount of 4,340 g was added to a mixture liquid of 5,400 g of water and 15 g of triethylamine while strongly stirring the mixture liquid.

Next, 1,500 g of ice was poured in the mixture liquid, and then 626 g of a 35% aqueous solution of 2-methyl-1,5-pentanediamine was added thereto to cause a chain extension reaction. The solvent was distilled away so that the solid content concentration became 30%. Thus, a polycarbonate urethane resin emulsion A, containing 30% of urethane resin components, 64% of water, and 6% of dipropylene glycol dimethyl ether, was prepared.

The polycarbonate urethane resin emulsion A was applied onto a glass slide and dried for 30 minutes at 100° C. to become a resin film having a thickness of 10 μm. The resin film had a Martens hardness of 120 N/mm$^2$ when measured by impressing a Vickers intender on the film with a load of 9.8 mN using a micro surface hardness tester (FISCHERSCOPE HM2000 available from Fischer).

Preparation of Polymer Solution

After sufficiently replacing the air in a 1-L flask equipped with a mechanical stirrer, a thermometer, a nitrogen gas inlet pipe, a reflux pipe, and a dropping funnel with nitrogen gas, 11.2 g of styrene, 2.8 g of acrylic acid, 12.0 g of lauryl methacrylate, 4.0 g of polyethylene glycol methacrylate, 4.0 g of styrene macromer, 0.4 g of mercaptoethanol, and 40 g of methyl ethyl ketone were mixed in the flask and heated to 65° C.

Next, a mixture liquid containing 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer, 3.6 g of mercaptoethanol, 2.4 g of azobis methylvaleronitrile, and 342 g of methyl ethyl ketone was dropped in the flask over a period of 2.5 hours. Next, another mixture liquid containing 0.8 g of azobis methylvaleronitrile and 18 g of methyl ethyl ketone was further dropped in the flask over a period of 0.5 hours. After aging the mixture at 65° C. for 1 hour, 0.8 g of azobis methylvaleronitrile was added thereto, and the mixture was further aged for 1 hour. After completion of the reaction, 800 g a polymer solution having a concentration of 50% was obtained.

Preparation of Yellow-Pigment-Containing Polymer Particle Water Dispersion

First, 28 g of the polymer solution, 26 g of C.I. Pigment Yellow 74, 13.6 g of a 1-mol/L aqueous solution of potassium hydroxide, 20 g of methyl ethyl ketone, and 13.6 g of ion-exchange water were sufficiently mixed and stirred. The resulting mixture was kneaded with a roll mill.

The resulting paste was poured in 200 g of pure water and sufficiently stirred, and methyl ethyl ketone and water were distilled away using an evaporator. Thus, a yellow-pigment-containing polymer particle water dispersion having a solid pigment concentration of 15% by mass and a solid content concentration of 20% by mass was prepared.

Preparation of Yellow Pigment Ink

The following materials were mixed and stirred. The mixture was filtered with a 0.2-μm polypropylene filter, thus preparing a yellow pigment ink.

Yellow-pigment-containing polymer particle water dispersion prepared above: 15 parts Polycarbonate urethane resin emulsion A (containing 0.9 parts of dipropylene glycol dimethyl ether (having a boiling point of 171° C.)): 7.5 parts Acrylic resin emulsion (VONCOAT R-3380-E available from DIC Corporation): 2 parts Surfactant ($CH_3(CH_2)_{12}O(CH_2CH_2O)_3CH_2COOH$): 2 parts Propylene glycol (having a boiling point of 188° C.): 20 parts Diethylene glycol n-butyl ether (having a boiling point of 230° C.): 15 parts Antiseptic antifungal agent (PROXEL LV available from Avecia): 0.1 parts Ion-exchange water: 38.4 parts Preparation of Magenta-Pigment-Containing Polymer Particle Water Dispersion First, 17.5 g of the polymer solution, 32.5 g of C.I. Pigment Red 122, 8.5 g of a 1-mol/L aqueous solution of potassium hydroxide, 13 g of methyl ethyl ketone, and 13.6 g of ion-exchange water were sufficiently mixed and stirred. The resulting mixture was kneaded with a roll mill.

The resulting paste was poured in 200 g of pure water and sufficiently stirred, and methyl ethyl ketone and water were distilled away using an evaporator. Thus, a magenta-pigment-containing polymer particle water dispersion having a solid pigment concentration of 15% by mass and a solid content concentration of 20% by mass was prepared.

Preparation of Magenta Pigment Ink

The following materials were mixed and stirred. The mixture was filtered with a 0.2-μm polypropylene filter, thus preparing a magenta pigment ink.

Magenta-pigment-containing polymer particle water dispersion prepared above: 15 parts Polycarbonate urethane resin emulsion A (containing 0.9 parts of dipropylene glycol dimethyl ether (having a boiling point of 171° C.)): 7.5 parts Acrylic resin emulsion (VONCOAT R-3380-E available from DIC Corporation): 2 parts Surfactant ($CH_3(CH_2)_{12}O(CH_2CH_2O)_3CH_2COOH$): 2 parts Propylene glycol (having a boiling point of 188° C.): 20 parts Diethylene glycol n-butyl ether (having a boiling point of 230° C.): 15 parts Antiseptic antifungal agent (PROXEL LV available from Avecia): 0.1 parts Ion-exchange water: 38.4 parts Preparation of Cyan-Pigment-Containing Polymer Particle Water Dispersion The procedure for preparing the yellow-pigment-containing polymer particle water dispersion was repeated except for replacing the C.I. Pigment Yellow 74 with C.I. Pigment Blue 15:3. Thus, a cyan-pigment-containing polymer particle water dispersion was prepared.

Preparation of Cyan Pigment Ink

The following materials were mixed and stirred. The mixture was filtered with a 0.2-μm polypropylene filter, thus preparing a magenta pigment ink.

Cyan-pigment-containing polymer particle water dispersion prepared above: 15 parts Polycarbonate urethane resin emulsion A (containing 0.9 parts of dipropylene glycol dimethyl ether (having a boiling point of 171° C.)): 7.5 parts Acrylic resin emulsion (VONCOAT R-3380-E available from DIC Corporation): 2 parts Surfactant ($CH_3(CH_2)_{12}O(CH_2CH_2O)_3CH_2COOH$): 2 parts Propylene glycol (having a boiling point of 188° C.): 20 parts Diethylene glycol n-butyl ether (having a boiling point of 230° C.): 15 parts Antiseptic antifungal agent (PROXEL LV available from Avecia): 0.1 parts Ion-exchange water: 38.4 parts Preparation of Black Pigment Ink KM-9036 (a self-dispersible pigment available from Toyo Ink Co., Ltd.): 15 parts Polycarbonate urethane resin emulsion A (containing 0.9 parts of dipropylene glycol dimethyl ether (having a boiling point of 171° C.)): 7.5 parts Acrylic resin emulsion (VONCOAT R-3380-E available from DIC Corporation): 2 parts Surfactant ($CH_3(CH_2)_{12}O(CH_2CH_2COOH$): 2 parts Propylene glycol (having a boiling point of 188° C.): 20 parts Diethylene glycol n-butyl ether (having a boiling point of 230° C.): 15 parts Antiseptic antifungal agent (PROXEL LV available from Avecia): 0.1 parts Ion-exchange water: 38.4 parts Evaluations The above-prepared inks, obtained by mixing ink compositions at room temperature and filtering the mixed ink compositions with a 0.2-μm polypropylene filter, were used as evaluation inks.

The cleaning and filling liquids according to Examples and Comparative Examples were subjected to the following Evaluations 1 to 6.

In Evaluation 1, properties of the cleaning and filling liquids according to Examples and Comparative Examples themselves were evaluated.

In Evaluations 3, the cleaning and filling liquids according to Examples and Comparative Examples were evaluated with the magenta evaluation ink prepared above. In Evaluations 5 and 6, a composite black solid image formed with all the yellow, magenta, cyan, and black evaluation inks was used for evaluation.

Evaluation 1: Foaming and Defoaming Property of Cleaning and Filling Liquids

First, 10 ml of each cleaning and filling liquid was contained in a 100-ml measuring cylinder, and air is injected in the cleaning and filling liquid at 10° C. The injection of air was terminated when the total volume of the cleaning and filling liquid and the generated foam became 100 ml or when 60 seconds elapsed.

The time from start to end of the injection of air was defined as a foaming time. The time from the end of the injection of air until the total volume of the ink and the generated foam became 20 ml was defined as a defoaming time.

Foaming and defoaming properties were evaluated by the foaming and defoaming time, respectively, based on the following criteria. The evaluated foaming or defoaming property, whichever is worse, was employed as the property of the cleaning and filling liquid.

Evaluation Criteria

Foaming Property

A: No foam was generated.

B: The foaming time was 30 seconds or more.

C: The foaming time was 15 seconds or more and less than 30 seconds.

D: The foaming time was less than 15 seconds.

Defoaming Property

A: The defoaming time was less than 10 seconds (including the case in which no foam was generated).

B: The defoaming time was 10 seconds or more and less than 20 seconds.

C: The defoaming time was 20 seconds or more and less than 30 seconds.

D: The defoaming time was 30 seconds or more.

Evaluation 2: Cleaning Ability of Cleaning and Filling Liquids

Cartridges filled with the evaluations ink were mounted on an inkjet printer equipped with a heating fan (a modified machine of IPSiO GXe 5500 available from Ricoh Co., Ltd.). After being filled with the evaluation inks, the inkjet printer printed a nozzle check pattern to be used for confirming whether nozzle omission had occurred or not.

Next, after replacing the cartridges with other cartridges filled with the cleaning and filling liquid, the printer performed a head-refreshing operation six times. A maintenance unit of the printer was then put into operation to suck 4.5 cc of the liquid from the head and refilled therein. This operation was repeated three times. The liquid sucked in the last operation was subjected to a measurement of absorbance. Specifically, the absorbance A1 of the ink and the absorbance A2 of the sucked liquid were measured at the maximum absorption wavelength ($\lambda_{Max}$) of the ink. The cleaning ability of the liquid was evaluated by the value calculated by the formula: (A2/A1)×100(%), based on the following criteria.

Evaluation Criteria

A: Less than 0.5%.

B: Not less than 0.5% and less than 1%.

C: Not less than 1% and less than 2%.

D: Not less than 2%.

Evaluation 3: Compatibility

A mixture of 97 g of each cleaning and filling liquid and 3 g of the evaluation ink was left in a thermostatic chamber at 90° C. for 8 hours.

The mixture was then taken out from the their iostatic chamber and left at rest for 2 hours. The condition of the mixture liquid was visually observed thereafter. The compatibility between the cleaning and filling liquid and the evaluation ink was evaluated based on the following criteria.

Evaluation Criteria

A: No phase separation was observed in the mixture liquid.

B: Slight density variation was observed in the mixture liquid.

C: Slight deposition of the colorant was observed in the mixture liquid.

D: Deposition of the colorant was observed in the mixture liquid.

Evaluation 4: Refilling Property

The inkjet printer equipped with a heating fan (a modified machine of IPSiO GXe 5500 available from Ricoh Co., Ltd.) that had been used in the above Evaluation 2 and cleaned thereafter was left in a thermostatic chamber at 40° C. for 24 hours. After ink cartridges filled with the evaluation inks were mounted on the printer, the printer performed an initial filling operation. The printer then repeatedly printed a nozzle check pattern and performed a filling operation and a head-refreshing operation, until no indication of defective discharge (e.g., such as nozzle misfiring and curved discharging, indicated by white or black lines in the images) was observed in the nozzle check pattern. The refilling property was evaluated by the number of times the head-refreshing operation was performed (at most 8 times) based on the following criteria.

Evaluation Criteria

A: The head-refreshing operation was performed once or less.

B: The head-refreshing operation was performed two or three times.

C: The head-refreshing operation was performed three or four times.

D: The head-refreshing operation was performed five times or more, or the printer was not able to recover.

Evaluation 5: Drying Property

The inkjet printer equipped with a heating fan (a modified machine of IPSiO GXe 5500 available from Ricoh Co., Ltd.) that had recovered from defective discharge in the above Evaluation 4 printed a solid image on a white vinyl chloride sheet IJ5331 (available from Sumitomo 3M Limited). The solid image was dried with the heating fan at 60° C. A piece of filter paper was pressed against the dried solid image. The drying property was evaluated by the degree of transfer of the ink onto the filter paper based on the following criteria.

Evaluation Criteria

A: Ink transfer did not occur after 15 minutes of drying at 60° C.

B: Ink transfer did not occur after 30 minutes of drying at 60° C.

C: Ink transfer did not occur after 60 minutes of drying at 60° C.

D: Ink transfer occurred even after 60 minutes of drying at 60° C.

Evaluation 6: Image Gloss Value

The solid images formed in Evaluation 5 were subjected to a measurement of 60° gloss value with a gloss meter (4501 available from BYK-Gardner) and evaluated based on the following criteria.

Evaluation Criteria

A: The 60° gloss value was 100% or greater.

B: The 60° gloss value was in the range of from 80% to 100%.

C: The 60° gloss value was in the range of from 60% to 80%.

D: A: The 60° gloss value was less than 60%.

The results of Evaluations 1 to 6 are shown in Table 1.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cleaning liquid for an inkjet recording apparatus, comprising:

an organic solvent having a boiling point of less than 250° C., the organic solvent including:

two or more methoxy-group-containing organic solvents; and

TABLE 1

| | Constituents | Type | b.p. (° C.) | Examples 1 | 2 | 3 | 4 | 5 | 6 | 7 | 8 | Comparative Examples 1 |
|---|---|---|---|---|---|---|---|---|---|---|---|---|
| Compositions of Cleaning and Filling Liquids | Water | Ion-exchange Water | | 75 | 69 | 69 | 69 | 74 | 69 | 69 | 69 | 78 |
| | Methoxy-group-containing Organic Solvents | 3-Methoxy-3-methyl-1-butanol | 174 | 3 | 3 | | 3 | 3 | 3 | 3 | 3 | 3 |
| | | 3-Methoxy-N,N-dimethylpropionamide | 216 | 3 | | 9 | 9 | 6 | 9 | 9 | 9 | |
| | | Diethylene glycol monomethyl ether | 194 | | 9 | 3 | | | | | | |
| | Other Organic Solvents | 1,4-Butanediol | 230 | | | | | | | | | |
| | | 2,3-Butanediol | 183 | 17 | 17 | 17 | 17 | 17 | | | | 17 |
| | | 1,2-Butanediol | 194 | | | | | | 17 | | | |
| | | 1,3-Propanediol | 214 | | | | | | | 17 | | |
| | | 1,2-Propanediol | 187 | | | | | | | | 17 | |
| | | Glycerin | 290 | | | | | | | | | |
| | Surfactant | Nonionic surfactant (EP-5035) | | 2 | 2 | 2 | 2 | 2 | 2 | 2 | 2 | 2 |
| | Ink Total | | | 100 | 100 | 100 | 100 | 100 | 100 | 100 | 100 | 100 |
| Evaluations | Evaluation 1: Foaming and Defoaming Property | | A | A | A | A | A | A | A | A | A | B |
| | Evaluation 2: Cleaning Ability | | A | A | A | A | A | A | A | A | A | B |
| | Evaluation 3: Compatibility | | A | B | B | A | A | A | A | A | A | C |
| | Evaluation 4: Refilling Property | | A | A | A | A | A | A | A | A | A | D |
| | Evaluation 5: Drying Property | | B | A | B | A | A | A | A | A | A | B |
| | Evaluation 6: Image Gloss Value | | B | B | B | B | B | B | B | B | B | C |

| | Constituents | Type | b.p. (° C.) | Comparative Examples 2 | 3 | 4 | 5 | 6 | 7 | 8 | 9 |
|---|---|---|---|---|---|---|---|---|---|---|---|
| Compositions of Cleaning and Filling Liquids | Water | Ion-exchange Water | | 72 | 81 | 69 | 69 | 75 | 69 | 72 | 72 |
| | Methoxy-group-containing Organic Solvents | 3-Methoxy-3-methyl-1-butanol | 174 | | | 3 | 3 | 3 | 3 | 9 | |
| | | 3-Methoxy-N,N-dimethylpropionamide | 216 | 9 | | 9 | 9 | 3 | 9 | | 9 |
| | | Diethylene glycol monomethyl ether | 194 | | | | | | 17 | 17 | 17 |
| | Other Organic Solvents | 1,4-Butanediol | 230 | | | | 17 | 17 | | | |
| | | 2,3-Butanediol | 183 | 17 | 17 | | | | | | |
| | | 1,2-Butanediol | 194 | | | | | | | | |
| | | 1,3-Propanediol | 214 | | | | | | | | |
| | | 1,2-Propanediol | 187 | | | | | | | | |
| | | Glycerin | 290 | | | 17 | | | | | |
| | Surfactant | Nonionic surfactant (EP-5035) | | 2 | 2 | 2 | 2 | 2 | 2 | 2 | 2 |
| | Ink Total | | | 100 | 100 | 100 | 100 | 100 | 100 | 100 | 100 |
| Evaluations | Evaluation 1: Foaming and Defoaming Property | | A | B | C | A | A | A | A | A | A |
| | Evaluation 2: Cleaning Ability | | A | C | C | A | A | A | A | A | A |
| | Evaluation 3: Compatibility | | A | B | C | A | A | A | C | C | C |
| | Evaluation 4: Refilling Property | | A | C | D | A | A | A | A | A | A |
| | Evaluation 5: Drying Property | | B | B | B | C | C | C | B | B | B |
| | Evaluation 6: Image Gloss Value | | B | C | C | D | D | D | C | C | C |

at least one member selected from the group consisting of 1,2-propanediol, 1,3-propanediol, 1,2-butanediol, and 2,3-butanediol, wherein the cleaning liquid includes no organic solvent having a boiling point of 250° C. or more.

2. The cleaning liquid of claim 1, wherein the organic solvent having a boiling point of less than 250° C. accounts for 25% by mass of the cleaning liquid.

3. The cleaning liquid of claim 1, wherein the methoxy-group-containing organic solvents include 3-methoxy-3-methyl-1-butanol and 3-methoxy-N,N-dimethylpropionamide, and a mass ratio of the 3-methoxy-3-methyl-1-butanol to the 3-methoxy-N,N-dimethylpropionamide ranges from ¼ to ½.

4. A method for cleaning an inkjet recording apparatus, comprising:

filling a cleaning liquid in an ink supply passage of the inkjet recording apparatus which is filled with an ink, the cleaning liquid including no organic solvent having a boiling point of 250° C. or more, and the cleaning liquid comprising instead an organic solvent having a boiling point of less than 250° C. and including:

two or more methoxy-group-containing organic solvents; and at least one member selected from the group consisting of 1,2-propanediol, 1,3-propanediol, 1,2-butanediol, and 2,3-butanediol; and flowing the cleaning liquid in the ink supply passage, wherein the following formula being satisfied:

$$(A2/A1)\times 100\leq 2 \quad (1)$$

wherein A1represents an absorbance of the ink and A2 represents an absorbance of a liquid present in the ink supply passage after the flowing.

5. A method for cleaning an inkjet recording apparatus, comprising:

filling a cleaning liquid in an ink supply passage of the inkjet recording apparatus which is filled with an ink, the cleaning liquid including no organic solvent having a boiling point of 250° C. or more, and the cleaning liquid comprising instead an organic solvent having a boiling point of less than 250° C. and including:

two or more methoxy-group-containing organic solvents; and at least one member selected from the group consisting of 1,2-propanediol, 1,3-propanediol, 1,2-butanediol, and 2,3-butanediol; and discharging the cleaning liquid from the ink supply passage; and repeating the filling and the discharging until the following formula is satisfied:

$$(A2/A1)\times 100\leq 2 \quad (1)$$

wherein A1 represents an absorbance of the ink and A2 represents an absorbance of a liquid present in the ink supply passage after the discharging.

6. A recoding method, comprising:

filling an ink supply passage of an inkjet recording apparatus with the cleaning liquid of claim 1;

refilling the ink supply passage with an ink; and discharging the ink from the ink supply passage onto a non-porous substrate to record an image thereon.

7. A cleaning and filling liquid comprising the cleaning liquid of claim 1.

* * * * *